US007150701B2

(12) United States Patent
Lines et al.

(10) Patent No.: US 7,150,701 B2
(45) **Date of Patent: *Dec. 19, 2006**

(54) CABLE-AND-PULLEY DEVICES HAVING INTERMEDIATE TENSION ISOLATORS FOR EXERCISE MACHINES

(75) Inventors: L. Kent Lines, Carnation, WA (US); A. Buell Ish, III, Redmond, WA (US)

(73) Assignee: Vectra Fitness, Inc., Kent, WA (US)

( * ) Notice: Subject to any disclaimer, the term of this patent is extended or adjusted under 35 U.S.C. 154(b) by 154 days.

This patent is subject to a terminal disclaimer.

(21) Appl. No.: 10/392,281

(22) Filed: Mar. 18, 2003

(65) Prior Publication Data

US 2004/0198565 A1 Oct. 7, 2004

Related U.S. Application Data

(63) Continuation of application No. 09/500,186, filed on Feb. 7, 2000, now Pat. No. 6,582,346.

(51) Int. Cl.
*A63B 21/00* (2006.01)

(52) U.S. Cl. ..... 482/102; 482/139; 482/98

(58) Field of Classification Search ..... 482/102, 482/139, 98, 101, 100, 99
See application file for complete search history.

(56) References Cited

U.S. PATENT DOCUMENTS 931,699 A 8/1909 Medart
4,721,301 A 1/1988 Drake
5,054,773 A 10/1991 Parviainen
5,267,930 A 12/1993 Henes
5,518,477 A 5/1996 Simonson
5,624,362 A 4/1997 Wilson

*Primary Examiner*—Jerome Donnelly
(74) *Attorney, Agent, or Firm*—Lee & Hayes PLLC

(57) ABSTRACT

Cable-and-pulley devices having intermediate tension isolators for exercise machines. In one embodiment, a cable-and-pulley device includes a cable attached to a load and to a user interface, and operatively engaged with a main pulley positioned over the load, a floating pulley, and an end pulley proximate the user interface. A second user interface is attached to the floating pulley. A tension isolator is positioned on the cable at an intermediate position between the end pulley and the floating pulley so that a training force applied on a second user interface draws the tension isolator into contact with the an isolator stop. In one embodiment, the isolator stop is an intermediate pulley. Alternately, the isolator stop is a catch projecting from a frame of the exercise machine. The tension isolator effectively divides the cable into a tensioned portion and an isolated portion, thereby reducing the amount of cable that is stretched during use of the second user interface. In alternate embodiments, the tension isolator may include a stop mechanically secured to the cable, or a coupling member coupled between the tensioned portion and the isolated portion. Alternately, the tension isolator may be integrally formed with the cable. In other alternate embodiments, a cable-and-pulley device may include a plurality of tension isolators positioned on one or more of the cables.

15 Claims, 5 Drawing Sheets

CABLE-AND-PULLEY DEVICES HAVING INTERMEDIATE TENSION ISOLATORS FOR EXERCISE MACHINES

This application is a continuation of U.S. patent application Ser. No. 09/500,186, filed Feb. 7, 2000, and issued as U.S. Pat. No. 6,582,346 on Jun. 24, 2003.

TECHNICAL FIELD

The present invention relates to cable-and-pulley devices having intermediate tension isolators for exercise machines.

BACKGROUND OF THE INVENTION

The convenience, efficiency, and safety of weight-training exercise machines is widely recognized. Popular weight-training exercise machines feature multiple stations at which a user may perform a variety of exercises for developing and toning different muscle groups. For example, an exercise machine may include a "press" station for exercising the chest and shoulders, a leg station for exercising the legs, and a pull-down station for exercising the arms and upper body, or other training stations. Exercise machines typically include a weight stack that may provide a variable training load. The user simply adjusts the position of a pin to attach a desired number of weight plates to a cable-and-pulley device to achieve a desired training load.

FIG. 1 is an isometric view of an exercise machine 100 having four exercise stations (or "user interface" stations): a press station 102, a leg curl station 104, a low pull station 106, and a high pull station 108. The exercise machine 100 includes a frame 139 and a cable-and-pulley device 120 that operatively attaches each of the exercise stations to a weight stack 112. In operation, a user (not shown) may perform, for example, a press exercise by lying on a seat 114 and grasping a pair of handles 116. The user than applies a training force to the handles 116 by pressing the handles 116 away from the user's chest. The training force is transmitted through the cable-and-pulley device 120 and applies a lifting force on at least a portion of the weight stack (a training load) 118. As the user overcomes the gravitational force on the training load 118, the handles 116 are displaced and the training load 118 is raised. Exercise machines of the type shown in FIG. 1 are disclosed, for example, in U.S. Pat. No. 4,986,538 to Ish, incorporated herein by reference.

FIG. 2 is a schematic view of the cable-and-pulley device 120 of the exercise machine 100 of FIG. 1. The cable-and-pulley device 120 includes a first cable 122 attached to the training load 118 and to the high pull station 108. The first cable 122 is trained about a first end pulley 124 proximate the high pull station 108, a first intermediate pulley 126, a first upper pulley 128 of a first double-floating pulley 130, and a main pulley 132 positioned over the training load 118. As used herein, the designation "end pulley" refers to a pulley that is located immediately adjacent to a user interface station, while "intermediate pulley" generally refers to a pulley that is not an "end pulley."

The cable-and-pulley device 120 also includes a second cable 132 that is attached to the low pull station 106 and is trained about a second end pulley 134 and a first lower pulley 129 of the first double-floating pulley 130. The second cable 132 also is trained over a second intermediate pulley 136, a third intermediate pulley 138, a fourth intermediate pulley 140, and a second upper pulley 142 of a second double-floating pulley 144. An end 146 of the second cable 132 is fixed in a stationary position. A third cable 148 is attached to the leg curl station 104 and is trained over a third end pulley 150, a fifth intermediate pulley 152, a second lower pulley 143 of the second double-floating pulley 144, a fourth end pulley 154, and finally, is attached to the press station 102.

Cable stops 156, 158, 160, 162 are attached to the cables 122, 132, 148 proximate each of the end pulleys 124, 134, 150, 154. FIG. 3 is an enlarged, partially exploded view of a cable stop 156 attached to the first cable 122 of the cable-and-pulley device 120. The cable stop 156 includes a stop ball 159 having a bore 161 therethrough. The first cable 122 is passed through the bore 161. A flanged ball 163 is then positioned on the first cable 122 and is swaged or otherwise fixed into position. The stop ball 159 is then slid back along the first cable 122 into engagement with the flanged ball 163, locking the stop ball 159 into position. A free end 123 of the first cable 122 continues on through the flanged ball 163 for attachment to a pull handle 109 (see FIG. 1) of the high pull station 108. A variety of other cable stop configurations may be used, including "genie bottle"-shaped stops.

As described in U.S. Pat. No. 4,986,538, the cable stops prevent retraction of the cables through the end pulleys as one of the user interface stations is being used. For example, when the user performs the press exercise as described above, the cable stop 160 is drawn into contact with the third end pulley 150 and a portion of the frame 139. The tension in the third cable 148 pulls downwardly on the second double-floating pulley 144, creating tension in the second cable 132 that draws the cable stop 158 into contact with the second end pulley 134. In turn, the tension in the second cable 132 pulls downwardly on the first double-floating pulley 130, creating tension in the first cable 122. The tension in the first cable 122 draws the cable stop 156 into contact with the first end pulley 124, and lifts the training load 118.

Beneficial results have been achieved using the cable-and-pulley device 120 and the exercise machine 100. Generally, however, virtually all exercise machines that use cable-and-pulley devices experience a characteristic stretching of the cables as the user applies a training force at one of the user interface stations. In some instances, the stretching of the cables may be imperceptible to the user. The stretching of the cables may become more perceptible to the user, however, as the number of cables in the cable-and-pulley device increases, as the length of the cables is increased, or as the magnitude of the training load is increased. Thus, the stretching of the cable may detract from the user's satisfaction, or may adversely impact the performance of the machine.

SUMMARY OF INVENTION

The present invention is directed to cable-and-pulley devices having intermediate tension isolators for exercise machines. In one aspect, a cable-and-pulley device includes a cable attached to a load and to a user interface, and operatively engaged with a main pulley positioned over the load, a floating pulley, and an end pulley proximate the user interface. A second user interface is attached to the floating pulley. A tension isolator is positioned on the cable at an intermediate position between the end pulley and the floating pulley so that a training force applied on a second user interface draws the tension isolator into contact with the an isolator stop. In one aspect, the isolator stop is an intermediate pulley. Alternately, the isolator stop is a catch projecting from a frame of the exercise machine. The tension isolator effectively divides the cable into a tensioned portion and an isolated portion, thereby reducing the amount of cable that is stretched during use of the second user interface.

In alternate aspects, the tension isolator may include a stop mechanically secured to the cable, or a coupling member coupled between the tensioned portion and the isolated portion. Alternately, the tension isolator may be integrally formed with the cable. In other alternate aspects, a cable-and-pulley device may include a plurality of tension isolators positioned on one or more of the cables.

DETAILED DESCRIPTION OF THE INVENTION

The present invention is generally directed to cable-and-pulley devices having intermediate cable isolators for exercise machines. Many specific details of certain embodiments of the invention are set forth in the following description and in FIGS. 4–9 to provide a thorough understanding of such embodiments. One skilled in the art will understand, however, that the present invention may have additional embodiments, or that the present invention may be practiced without several of the details described in the following description.

Figure 4:
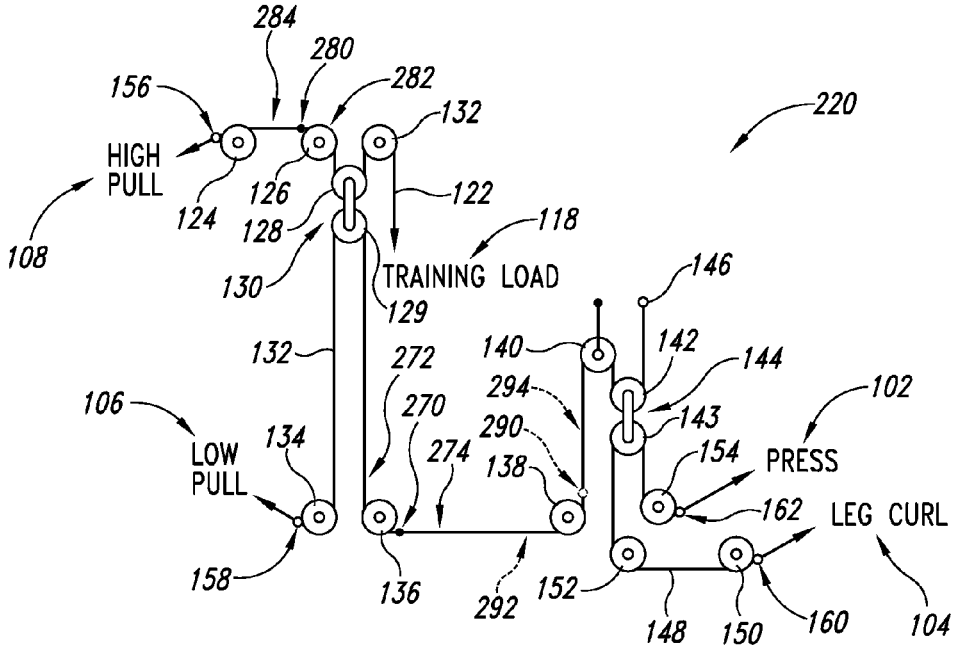
FIG. 4 is a schematic view of a cable-and-pulley device having a tension isolator in accordance with an embodiment of the invention.
Figure 7:
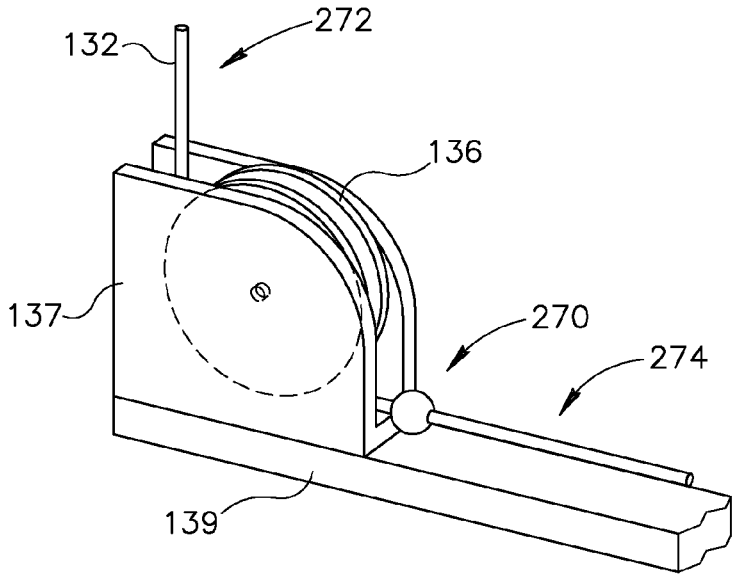
FIG. 7 is an enlarged, isometric view of the tension isolator and third intermediate pulley of FIG. 4.

FIG. 4 is a schematic view of a cable-and-pulley device 220 in accordance with an embodiment of the invention. In this embodiment, the cable-and-pulley device 220 includes all of the elements of the cable-and-pulley device 120 described above, and further includes a tension isolator 270. The tension isolator 270 is positioned on the second cable 132 near the third intermediate pulley 136. FIG. 7 is an enlarged isometric view of the tension isolator 270 and the third intermediate pulley 136. The third intermediate pulley 136 is rotatably coupled to a shroud 137 that is attached to a support frame 139 of the exercise machine.

In operation, a user (not shown) may apply a training force at the high-pull station 108, creating a tension in the first cable 122. The first cable 122 pulls upwardly on the first double-floating pulley 130, creating tension in the second cable 132 which draws the cable stop 158 into contact with the second end pulley 134. The tension in the second cable 132 also draws the tension isolator 270 into contact with the third intermediate pulley 136 and the shroud 137. Thus, the tension isolator 270 effectively divides the second cable 132 into a tensioned portion 272 and an isolated portion 274. As the user performs an exercise at the high-pull station 108, only the first cable 122 and the tensioned portion 272 of the second cable 132 are subjected to tension. The isolated portion 274 of the second cable 132, and the third cable 148 are not tensioned in response to force applied by the user.

Alternately, the user may apply a training force at the low pull station 106, creating tension in the tensioned portion 272 of the second cable 132. The tension in the tensioned portion 272 pulls downwardly on the first double-floating pulley 130, creating tension in the first cable 122 which draws the cable stop 156 into contact with the first end pulley 124 and lifts the training load 118. Again, during use of the low pull station 106, the tension isolator 270 abuts against the third intermediate pulley 136 and the shroud 137 and isolates the isolated portion 274 of the second cable 132, and the third cable 148, from tension.

In the position shown in FIG. 4, the tension isolator 270 does not impact the operation of the press station 102 or the leg curl station 104. Thus, the isolated portion 274 of the second cable 132 is only isolated from tension during the high pull and low pull exercises. The entire length of the second cable 132 is tensioned during use of the press station 102 and the leg curl station 104. Because the tension isolator 270 is positioned near one of the intermediate pulleys rather than near one of the end pulleys, it may alternately be termed an "intermediate tension isolator." Throughout this description, the term tension isolator may be used interchangeably with the term "intermediate tension isolator."

The tension isolator 270 advantageously reduces the length of cable (and number of cables) tensioned by the user during use of the high pull and low pull stations 108, 106. Generally, the amount of stretch of a cable under a given load depends on, among other factors, the length of the cable. The tension isolator 270 isolates some of the cable and reduces the length of cable exposed to tension. Because a large portion of the second cable 132, and the entire third cable 148, are isolated from the tension, the amount of cable that is stretched during high pull or low pull exercises is significantly reduced. Because the stretch of the cable-and-pulley device is reduced, a "play" in the apparatus between the first application of a training force and the lifting of the load may be reduced. This may improve the performance of the exercise machine, and may increase the user's satisfaction.

Figure 1:
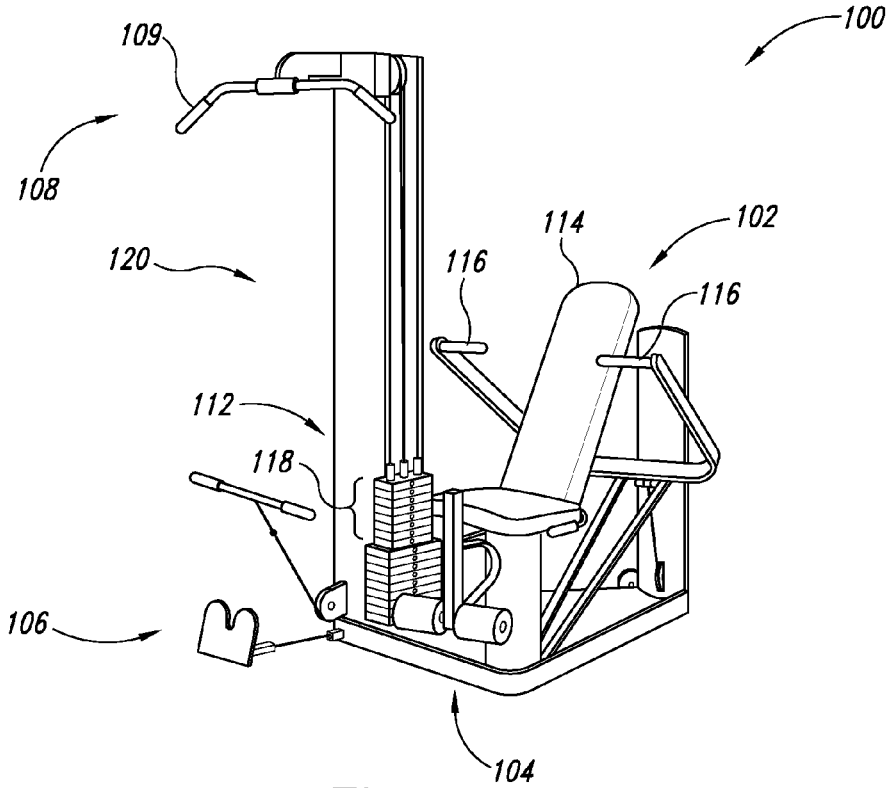
Fig. 1 (Prior Art)
FIG. 1 is an isometric view of an exercise machine in accordance with the prior art.
Figure 2:
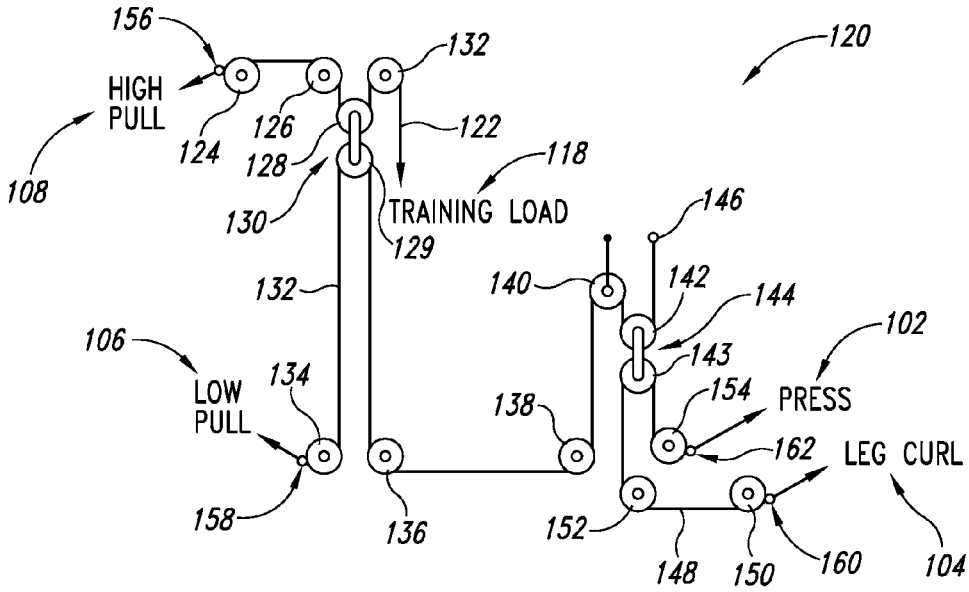
Fig. 2 (Prior Art)
FIG. 2 is a schematic view of a cable-and-pulley device of the exercise machine of FIG. 1.
Figure 3:
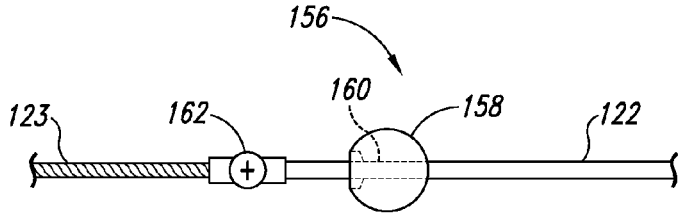
FIG. 3 is an enlarged, partially exploded view of a cable stop attached to a first cable of the cable-and-pulley device of FIG. 2.

It should be noted that the tension isolator 270 may be any suitable component, including, for example, the cable stop 156 shown in FIG. 3 and described above. The tension isolator 270 may be clamped, swaged, bolted, or otherwise secured to the cable. Alternately, the tension isolator 270 may be integrally formed with the second cable 132.

It should also be noted that the tension isolator 270 may be positioned at a variety of locations in the cable-and-pulley device 220. For example, in an alternate embodiment, a tension isolator 290 may be positioned on the second cable 132 near the fourth intermediate pulley 138, as shown in FIG. 4. In this location, the tension isolator 290 divides the second cable 132 into a tensioned portion 292 and an isolated portion 294. Although the isolated portion 294 is shorter (and the tensioned portion 292 is longer) than in the previously described embodiment, the desirable result of reduced cable stretching may still be achieved. In other embodiments, a tension isolator may be positioned on any of the other cables and/or near any of the other intermediate pulleys, single floating pulleys, or double-floating pulleys in the cable-and-pulley device. The design details of each particular cable-and-pulley device, and of each exercise machine, however, may limit the practicality of placing tension isolators at some locations.

Alternately, more than one tension isolator may be included in the cable-and-pulley device. For example, in addition to the tension isolator 270, a second tension isolator 280 may be positioned on the first cable 122 near the first intermediate pulley 126, as shown in FIG. 4. The second tension isolator 280 effectively divides the first cable 122 into a tensioned portion 282 and an isolated portion 284. Thus, during use of the press station 102, or the leg curl station 104, or the low pull station 106, the isolated portion 284 of the first cable 122 is not tensioned, and the characteristic cable stretching is reduced.

Figure 8:
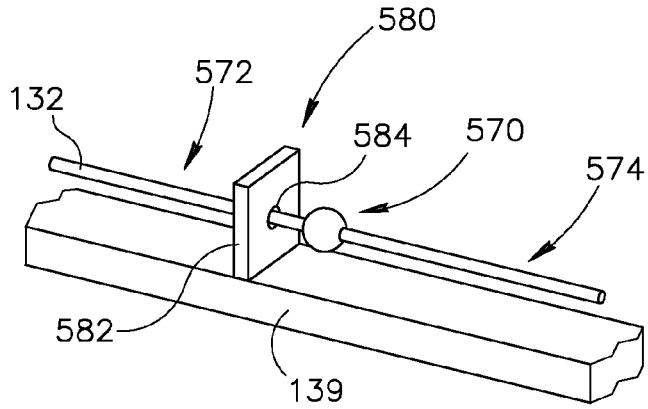
FIG. 8 is an enlarged isometric view of the tension isolator and an isolator catch of FIG. 4.

In another alternate embodiment, as shown in FIG. 4, a tension isolator 570 is positioned on the second cable 132 proximate an isolator catch 580 that projects from the frame 139. FIG. 8 is an enlarged isometric view of the tension isolator 570 and the isolator catch 580 of FIG. 4. The isolator catch 580 includes a plate 582 having a cable aperture 584 disposed therethrough. The plate 582 is attached to the frame 139. The cable aperture 584 is sized to permit the second cable 132 to pass loosely through the cable aperture 584, but is smaller than the tension isolator 570. As the user applies a training force at, for example, the high pull station 108, the tension isolator 570 is drawn into contact with the isolator catch 580, effectively dividing the second cable 132 into a tensioned portion 572 and an isolated portion 574.

The embodiment having an isolator catch 580 advantageously allows the tension isolator 570 to be positioned at any desirable intermediate location in the cable-and-pulley device. The tension isolator 570 does not need to be positioned adjacent to any of the pulleys in order to achieve the benefits of intermediate tension isolation.

Figure 5:
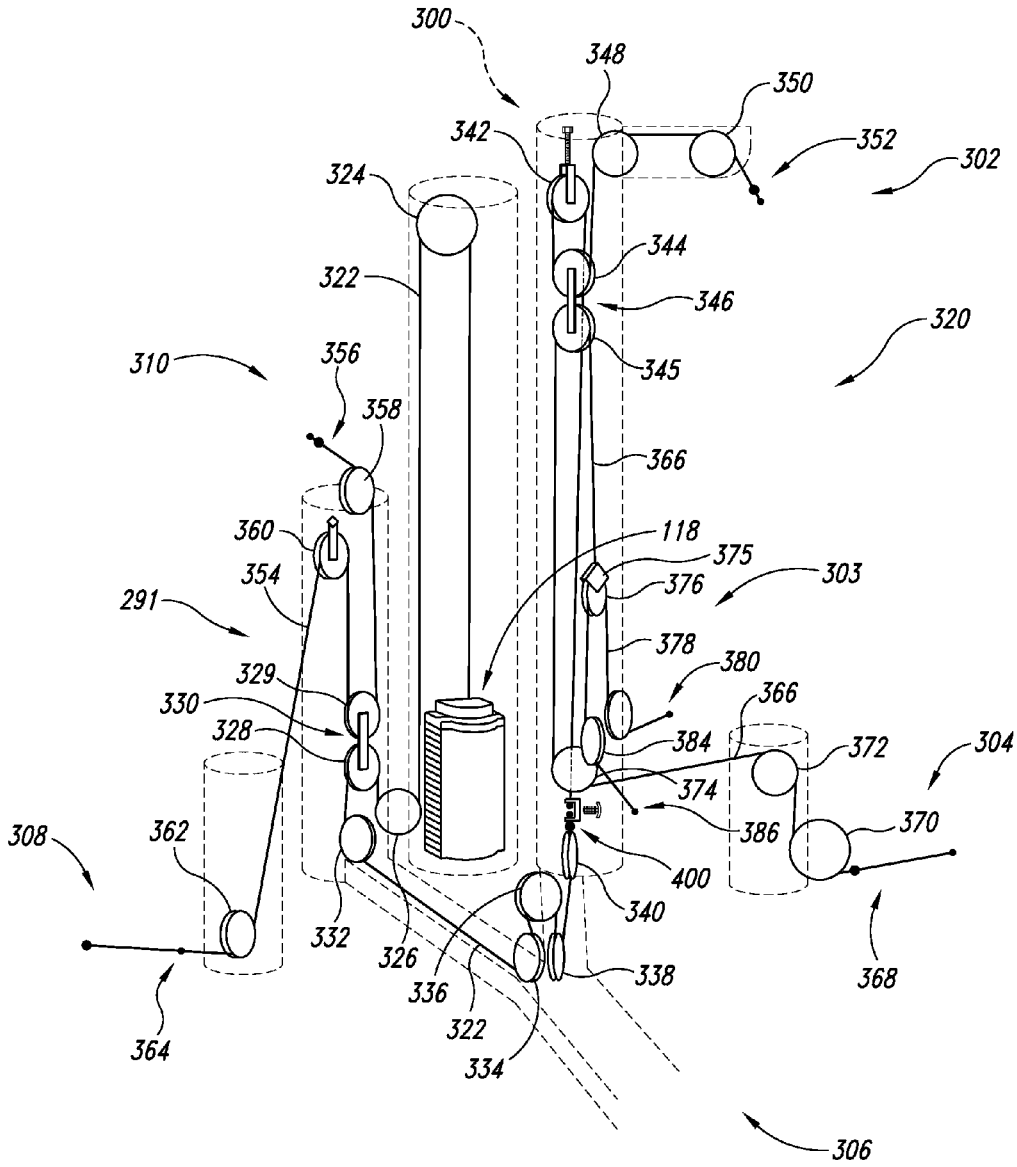
FIG. 5 is an isometric view of a cable-and-pulley device having a tension isolator in accordance with an alternate embodiment of the invention.

FIG. 5 is an isometric view of a cable-and-pulley device 320 in accordance with an alternate embodiment of the invention. The cable-and-pulley device 320 may be used, for example, with an exercise machine 300 having six user interface stations: a high pull station 302, a butterfly station 303, a low pull station 304, a press station 306, a leg station 308, and an abdominal (AB) station 310. Exercise machines of the type having six user interface stations are disclosed, for example, in the co-pending, commonly owned U.S. patent application Ser. No. 09/499,253 entitled "Apparatus and Methods for Exercise Machines Having Balancing Loads," filed on Feb. 7, 2000 and issued as U.S. Pat. No. 6,482,135 on Nov. 19, 2002, and incorporated herein by reference.

As shown in FIG. 5, the cable-and-pulley device 320 includes a first cable 322 attached to the training load 118. The first cable 322 is trained over a main pulley 324, a first intermediate pulley 326, a first lower pulley 328 of a first double-floating pulley 330, and a second intermediate pulley 332. The first cable 322 is trained about a third intermediate pulley 334, a first single-floating pulley 336, and a fourth intermediate pulley 338. A press handle (not shown) may be attached to the first single-floating pulley 336 at the press station 306, allowing a user to perform a variety of press exercises. The first cable 322 is trained about a fifth intermediate pulley 340, and is coupled to a tension isolator 400. A second cable 323 is coupled to the tension isolator 400 and is trained over a sixth intermediate pulley 342, a second upper pulley 344 of a second double-floating pulley 346, a seventh intermediate pulley 348, and a first end pulley 350 at the high pulley station 302. A first cable stop 352 is attached to the second cable 323 near the first end pulley 350. One may note that the first and second cables 322, 323 may be formed by parting a single, longer cable that previously exists in the place of the first and second cables 322, 323.

A third cable 354 is attached to a second cable stop 356 at the AB station 310. The third cable 354 is trained about a second end pulley 358, a first upper pulley 329 of the first double-floating pulley 330, an eighth intermediate pulley 360, and a third end pulley 362 at the leg station 308. A third cable stop 364 is attached to the third cable 354 near the third end pulley 362.

The cable-and-pulley device 320 also includes a fourth cable 366 attached to a fourth cable stop 368 at the low pulley station 304. The fourth cable 366 is trained about a fourth end pulley 370, a ninth and tenth intermediate pulley 372, 374, a second lower pulley 345 of the second double-floating pulley 346, and attaches to a pulley harness 375 of a second single-floating pulley 376. A fifth cable 378 is attached to a fifth cable stop 380 at the butterfly station 303, and is trained about a fifth end pulley 382, the second single-floating pulley 376, sixth end pulley 384, and is attached to a sixth cable stop 386.

Figure 6:
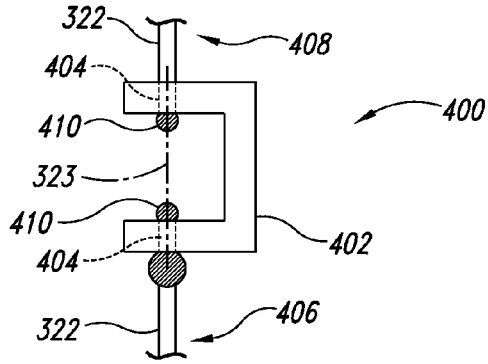
FIG. 6 is an enlarged, side elevational view of a tension isolator installed in a first cable of the cable-and-pulley device of FIG. 5.

The cable isolator 400 is coupled between the first cable 322 and the second cable 323 near the fifth intermediate pulley 340. FIG. 6 is an enlarged, side elevational view of the tension isolator 400 installed between the first and second cables 322, 323 of the cable-and-pulley device 320 of FIG. 5. The tension isolator 400 includes a U-shaped bracket 402 having a pair of cable apertures 404 disposed therethrough. The cable apertures 404 are aligned with a longitudinal axis 325 of the first and second cables 322, 323. The ends of the first and second cables 322, 323 are passed through the cable apertures 404. A retaining ball 410 is positioned on each of the ends of the first and second cables 322, 323 securing the first and second cables 322, 323 together with the bracket 402. A slide stop 412 is attached to the first cable 322 with the bracket 402 being tightly secured between the slide stop 412 and the retaining ball 410.

In operation, a user may apply a training force, for example, at the leg station 308, creating tension in the third cable 354. The tension in the third cable 354 pulls the second cable stop 356 into contact with the second end pulley 358, and pulls upwardly on the first upper pulley 329 of the first double-floating pulley 330, creating tension in the first cable 322. The tension in the first cable 322 pulls the tension isolator 400 into contact with the fifth intermediate pulley 340 (and shroud 137 shown in FIG. 7), and lifts the training load 118.

The tension isolator 400 isolates the second cable 323, and the fourth and fifth cables 366, 378 from being tensioned during the leg exercise. Thus, the above-noted advantages of reduced cable stretching may be achieved. In the position shown in FIG. 5, the tension isolator 400 does not impact the amount of cable that experiences tension, or the functioning of the cable-and-pulley device 320, during use of the high pull station 302, the butterfly station 303, or the low pull station 304.

Alternately, when the user applies a training force on the third cable 354 at the AB station 310, only the third cable 354 and the first cable 322 are tensioned. Similarly, when the user applies a training force on the first single-floating pulley 336 at the press station 306, only the first cable 322 and the third cable 354 are tensioned.

Thus, the tension isolator 400 reduces the amount of cable tensioned during use of the AB station 310, the leg station 308, and the press station 306 compared with comparable cable-and-pulley devices not having the tension isolator 400. Because the amount of tensioned cable is reduced, the amount of cable stretching is also reduced. The effectiveness of the exercise machine 300, and the user's satisfaction with the exercise machine 300, may thereby be improved.

Another advantage of the tension isolator 400 is that it enables existing pulley-and-cable devices to be easily retrofitted or modified to include the tension isolator 400. For example, in some existing exercise machines, a single longer cable may be used in place of the first and second cables 322, 323. Because the single longer cable 322 may be parted into the first and second cables 322, 323, and then re-coupled using the tension isolator 400, the tension isolator 400 may be installed in existing, assembled cable-and-pulley devices without substantial disassembly of the exercise machine 300. Thus, the installation of the tension isolator 400 may be simpler and less costly than, for example, alternate tension isolator embodiments that must be threaded along the entire length of the cable, or which require manufacture and installation of cables having an integrally formed tension isolator.

Figure 9:
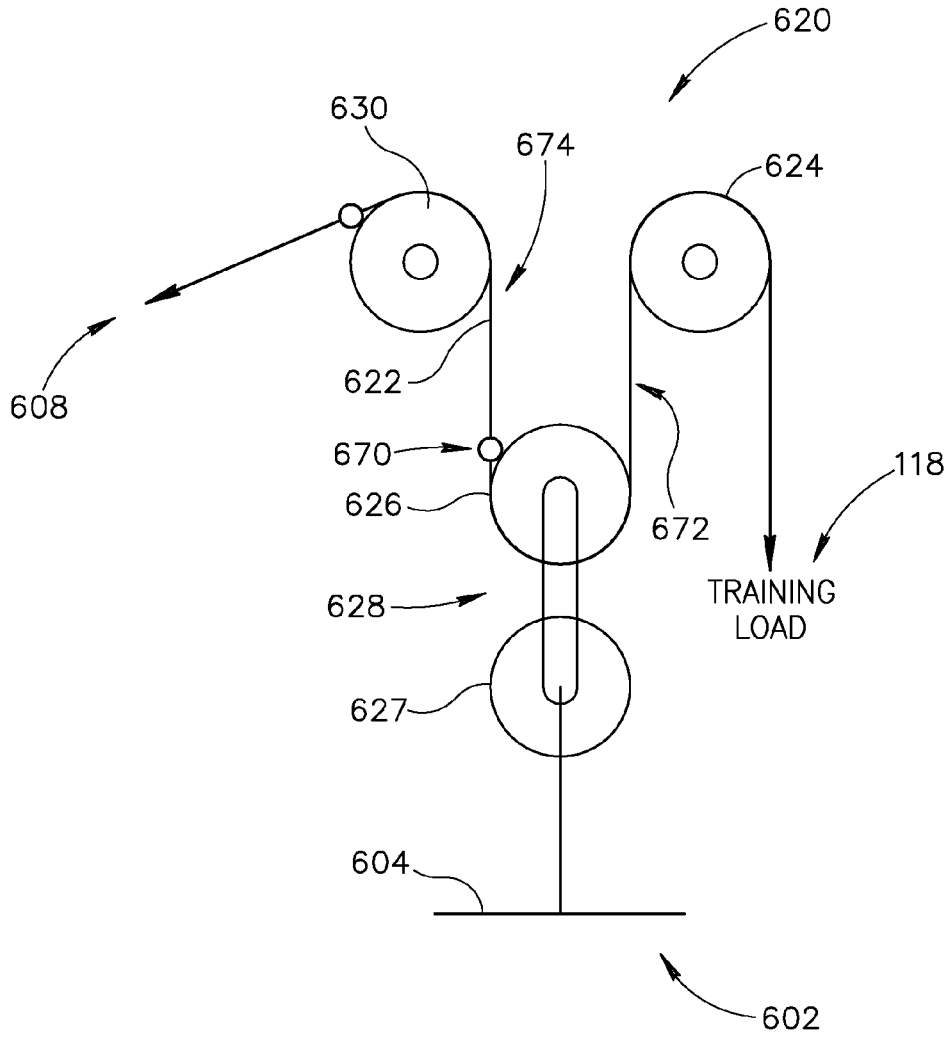
FIG. 9 is a schematic view of a cable-and-pulley device having a tension isolator in accordance with another embodiment of the invention.

FIG. 9 is a schematic view of a cable-and-pulley device 620 having a tension isolator 670 in accordance with another embodiment of the invention. In this embodiment, the cable-and-pulley device 620 includes a cable 622 having a first end attached to a training load 118 and a second end terminating at a first workout station 608. The cable 622 is trained over a main pulley 624 above the training load 118, an upper pulley 626 of a double-floating pulley 628, and an end pulley 630. A cable stop 632 is coupled to the cable 622 proximate the end pulley 630 at the first workout station 608. A second workout station 602 includes a handle 604 attached to the lower pulley 627 of the double-floating pulley 628. The tension isolator 670 is positioned on the cable 622 proximate the upper pulley 626.

In operation, a user applies a training force on the handle 604 at the second workout station 602, creating a tension in the cable 622. The tension isolator 670 contacts the upper pulley 626, dividing the cable 622 into a tensioned portion 672 and an isolated portion 674. The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other cable-and-pulley devices having intermediate tension isolators for exercise machines, and not just to the embodiments described above and shown in the accompanying figures. Accordingly, the scope of the invention should be determined from the following claims.

The invention claimed is:

1. A cable-and-pulley device for an exercise machine having first and second user interfaces and a load, comprising:

a cable having a first end coupled to the load and a second end coupled to the first user interface, the cable operatively engaging a main pulley positioned above the load, an end pulley proximate the first user interface, and a floating pulley operatively engaging the cable at a position intermediate the end pulley and the main pulley, the second user interface being operatively coupled to the floating pulley; and a tension isolator coupled to the cable at an intermediate portion of the cable between the end pulley and the main pulley; the tension isolator being adapted to engage a stop structure operatively positioned relative to the tension isolator when the cable is pulled in a first direction along a longitudinal axis of the cable, whereby a training force applied on the second user interface moves the tension isolator into contact with the stop structure, at least partially preventing subsequent motion of the cable along the first direction.

2. The cable-and-pulley device of claim 1 wherein the exercise machine includes a frame and wherein the stop structure comprises an isolator catch coupled to the frame.

3. The cable-and-pulley device of claim 1 wherein the stop structure includes at least a portion of the floating pulley.

4. The cable-and-pulley device of claim 1 wherein the cable comprises a tensioned portion and an isolated portion, and wherein the tension isolator comprises a coupling member coupled between the tensioned portion and the isolated portion.

5. The cable-and-pulley device of claim 1 wherein the tension isolator is integrally formed with the cable.

6. The cable-and-pulley device of claim 1 wherein the floating pulley comprises a double-floating pulley.

7. A cable-and-pulley device for an exercise machine having a first user interface, a second user interface, and a load, comprising:

a first cable operatively coupled to the first user interface and operatively engaging a double-floating pulley and a first end pulley spaced apart from the double-floating pulley;

a second cable operatively coupled to the second user interface and operatively engaging the double-floating pulley and a second end pulley spaced apart from the double-floating pulley;

a tension isolator operatively coupled to either the first or second cables at an intermediate portion thereof; and an isolator stop operatively positioned proximate the tension isolator, the isolator stop being adapted to engage the tension isolator when the cable is pulled in a first direction along a longitudinal axis of the cable, at least partially preventing subsequent motion of the cable along the first direction.

8. The cable-and-pulley device of claim 7 wherein the first cable includes a first end attached to the load.

9. The cable-and-pulley device of claim 7 wherein the tension isolator comprises a ball stop mechanically secured to the at least one cable.

10. The cable-and-pulley device of claim 7 wherein the at least one cable includes a tensioned portion and an isolated portion and wherein the tension isolator includes a coupling member coupled between the tensioned portion and the isolated portion.

11. The cable-and-pulley device of claim 7 wherein the tension isolator is integrally formed with the at least one cable.

12. A cable-and-pulley device for an exercise machine having a first user interface, a second user interface, and a load, comprising:

a first cable operatively coupled to the first user interface and operatively engaging a double-floating pulley, a first end pulley spaced apart from the double-floating pulley, and a first intermediate pulley that engages the first cable between the double-floating pulley and the first end pulley;

a second cable operatively coupled to the second user interface and operatively engaging the double-floating pulley, a second end pulley spaced apart from the double-floating pulley, and a second intermediate pulley that engages the second cable between the double-floating pulley and the second end pulley; and a tension isolator operatively coupled at an intermediate portion of either the first or second cable proximate the first or second intermediate pulley, respectively, the intermediate portion being opposite the first or second intermediate pulley from the double-floating pulley; the tension isolator being adapted to engage a frame of at least one of the first and second intermediate pulleys when a respective one of the first and second cables is pulled in a first direction along a longitudinal axis of the respective one of the first and second cables, at least partially preventing subsequent motion of the cable along the first direction.

13. The cable-and-pulley device of claim 12 wherein the first cable includes a first end attached to the load.

14. The cable-and-pulley device of claim 12 wherein the tension isolator comprises a stop mechanically secured to the intermediate portion.

15. The cable-and-pulley device of claim 12 wherein the double-floating pulley comprises a first double-floating pulley, further comprising a second double-floating pulley and a third cable, the second and third cables operatively engaging the second double-floating pulley.

* * * * *